US008182371B2

(12) United States Patent
Norman

(10) Patent No.: US 8,182,371 B2
(45) Date of Patent: May 22, 2012

(54) TETHER TENNIS GAME APPARATUS

(75) Inventor: Neville Marshall Norman, Ashford (GB)

(73) Assignee: Swingball Limited, Trident Chambers, Road Town, Tortola (VG)

( * ) Notice: Subject to any disclaimer, the term of this patent is extended or adjusted under 35 U.S.C. 154(b) by 281 days.

(21) Appl. No.: 12/532,087

(22) PCT Filed: Jul. 8, 2008

(86) PCT No.: PCT/IB2008/052739

§ 371 (c)(1), (2), (4) Date: Sep. 18, 2009

(87) PCT Pub. No.: WO2009/007912

PCT Pub. Date: Jan. 15, 2009

(65) Prior Publication Data

US 2010/0105505 A1 Apr. 29, 2010

(30) Foreign Application Priority Data

Jul. 9, 2007 (ZA) ..... 2007/05555

(51) Int. Cl.
*A63B 69/00* (2006.01)

(52) U.S. Cl. ..... 473/417; 473/462; 473/429; 473/430

(58) Field of Classification Search ..... 473/417, 473/422, 138, 147, 149, 423–425, 430, 476, 473/479, 575; D21/459, 455; 446/241
See application file for complete search history.

(56) References Cited

U.S. PATENT DOCUMENTS

| | | | | | |
|---|---|---|---|---|---|
| 2,140,411 | A * | 12/1938 | Wood | 473/575 |
| 2,297,118 | A * | 9/1942 | Wildegans | 473/147 |
| 2,417,565 | A * | 3/1947 | Norvell | 446/241 |
| 2,423,198 | A * | 7/1947 | McClure, Jr. | D21/459 |
| 2,458,668 | A * | 1/1949 | Wood | 473/506 |
| 3,107,094 | A * | 10/1963 | Kfoury | 473/575 |
| 3,730,526 | A * | 5/1973 | Litzka | 473/575 |
| 3,992,007 | A * | 11/1976 | Seeman | 473/575 |
| 4,093,225 | A * | 6/1978 | Oliver | 473/575 |
| 4,188,033 | A | 2/1980 | Wells | |
| 4,491,329 | A * | 1/1985 | Nielsen | 473/575 |
| 5,024,446 | A * | 6/1991 | Norman | 473/575 |
| 5,083,796 | A * | 1/1992 | Norman | 473/575 |
| 6,328,665 | B1 * | 12/2001 | Gormley | 473/423 |
| 6,705,960 | B2 * | 3/2004 | Gormley | 473/417 |

FOREIGN PATENT DOCUMENTS

GB 2246518 A1 2/1992

* cited by examiner

*Primary Examiner* — Mitra Aryanpour
(74) *Attorney, Agent, or Firm* — Bobby W. Braxton; Colin P. Cahoon; Carstens & Cahoon, LLP

(57) ABSTRACT

The invention relates to a tether tennis game apparatus which includes a hollow pole that has a helix formation extending externally therefrom along an operative top segment of the pole. The helix formation defines a helical guide path within which a loop formation, that is formed at one end of a flexible line which has a ball connected at its other end and that can be located around the pole, is displaceable. An indicator arrangement including an elongate indicator element, located for axial displacement within the pole, and a trigger arrangement is operable on the pole to indicate a winner of a game played with the apparatus and which occurs when the loop formation, at the end of a flexible line, reaches an end of the helical guide path.

10 Claims, 5 Drawing Sheets

TETHER TENNIS GAME APPARATUS

FIELD OF INVENTION

This invention relates to tether tennis game apparatus.

Tether tennis game apparatus includes conventionally an operatively vertically supported pole, a ball, a flexible line connecting the ball to the pole and two racquets whereby two players can strike the ball for displacing the ball along a generally circular path, in opposite directions around the pole. The end of the line remote from the ball and that connects the ball to the pole generally is provided with an engagement formation that engages a helical guide formation defined around an operative top segment of the pole and that provides for the engagement formation to be displaced upwardly or downwardly with respect to the pole, as determined by the direction of displacement of the ball around the pole. As such, with two players striking the ball in opposite directions, if one player misses the ball more often than the other, the engagement formation will move towards one of the ends of the helical guide formation, a winner of a game being the player that induces the engagement formation to reach "the other player's end of the guide formation". A difficulty that exists with playing the above game is that it is not always clearly apparent when the engagement formation has reached a player's end of the guide formation. As such, an indicator arrangement has been proposed that has an indicator element that is displaced with respect to the pole upon the engagement formation reaching either end of the guide formation.

U.S. Pat. No. 4,188,033 discloses such an indicator arrangement as part of a tether tennis game apparatus, the helical guide formation defined around an operative top segment of the pole of the apparatus in this case being in the form of an open spiral, such as a coil spring, that is secured to and that surrounds the pole. The line that connects the ball of the apparatus to the pole has an engagement formation in the form of a ring-like body tied to its free end, the ring-like body being slidably located on the spiral. The indicator arrangement has an indicator element comprising a sleeve that fits slidably on the pole and that is displaceable between a spring-loaded trapped position and a release position, a trigger mechanism associated with the spiral and forming part of the indicator arrangement being acted upon by the ring-like body, when it reaches either one of two end positions along the spiral, inducing the release of the sleeve for displacement from its trapped position to its release position, which is clearly visible, to indicate that a player has won a game.

U.S. Pat. No. 4,491,329 also discloses an indicator arrangement as part of a tether tennis game apparatus. In this case, the helical guide formation defined around an operative top segment of the pole of the apparatus is in the form of a helical thread and the ball of the apparatus is connected to the pole via its line by an engagement formation in the form of a nut that is rotatably located on the thread. The indicator arrangement has an indicator element in the form of a tubular body displaceably located within the pole for displacement between a spring-loaded trapped position and a release position, a trigger mechanism associated with the helical thread and forming a part of the indicator arrangement in this case being acted upon by the nut for the release of the tubular body from its trapped position. The resulting displacement of the tubular body to its release position is again clearly visible to indicate a winner.

In a more current form of a tether tennis game apparatus, the helical guide formation is a helix formation that projects from the pole along an operative top segment thereof, the helix formation defining a helical guide path around the pole along the said segment. The line that connects the ball of the apparatus to the pole has a loop formation formed at the free end thereof that fits around the pole and that, upon its displacement around the pole, is displaced along the helical guide path up or down the pole. Insofar as the loop formation formed at the free end of the line fits freely around the pole and the line diameter is substantially smaller than the width of the guide path within which the loop formation is displaceable, the principles associated with triggering of an indicator arrangement, as disclosed in the prior art referred to above, cannot be applied in relation to this apparatus, particularly also insofar as the path followed by the loop formation is not a precise path as is the case with a ring along a spiral and a nut on a threaded pole.

As such, it is an object of this invention to provide an indicator arrangement that is operable in conjunction with the above described more current form of a tether tennis game apparatus.

According to the invention there is provided a tether tennis game apparatus, which includes a hollow pole that has a helix formation extending externally therefrom along an operative top segment thereof, the helix formation defining a helical guide path along the segment, between an operative top end of the segment and an operative bottom end of the segment, within which a loop formation, that is formed at one end of a flexible line which has a ball connected to its other end and that can be located around the pole, is displaceable; and an indicator arrangement including an elongate indicator element located for axial displacement within the pole, the element being displaceable from a spring-loaded trapped position, in which it is retracted into the pole, to a release position, in which it has moved operatively upwardly and extends from the operative top end of the pole;

two trigger elements, located within the helical guide path defined by the helix formation of the pole near the respective operative ends of the path, each trigger element defining a guide formation and stop means, the guide formation being configured operatively to guide a loop formation, formed at the end of a flexible line to which a ball is connected and engaging the line with the pole, when rotatably displaced around the pole and axially displaced with respect to the pole along the helical guide path, to the stop means and the stop means being configured to stop the rotation of the loop formation around the pole and to be displaced in response to stopping the rotation of the loop formation around the pole; and a trap arrangement located within the pole and defining a trap formation for releasably trapping the indicator element in its spring-loaded trapped position, the trap formation and the indicator element being displaced with respect to one another, in response to displacement of the stop means, for releasing the indicator element for displacement to its release position.

The configuration of the hollow pole and of the helix formation extending externally therefrom is conventional, except insofar as it accommodates the indicator arrangement as hereinafter explained.

The elongate indicator element of the indicator arrangement of the tether tennis game apparatus of the invention typically is an elongate rod-like element and, as such, the indicator arrangement may include a first tubular housing within which the indicator element is displaceably located, the tubular housing having a spring located therein that acts between the indicator element and the housing to provide for spring loading of the indicator element when displaced into its trapped position and for displacement of the indicator element to its release position upon release by the trap formation of the trap arrangement.

The indicator element as above envisaged may have a pin formation projecting therefrom that extends through a slot defined therefor in the tubular housing, the slot extending axially along the tubular housing for serving as a guide path for displacement of the indicator element between its spring-loaded trapped position and its release position. The slot defined in the first tubular housing may define a helical path axially along the tubular housing, the slot, by having the pin formation projecting from the indicator element extending therethrough, inhibiting free rotation of the indicator element at any axial location thereof between its trapped position and its release position while inducing restricted rotation of the indicator element during its displacement from its trapped position to its release position. For the above arrangement, the indicator arrangement may include a propeller-type element rotatably located on a free end of the indicator element that projects from the pole of the apparatus in a configuration in which rotation of the indicator element upon its displacement from its trapped position to its release position induces rotation of the propeller-type element.

The guide formation of each trigger element of the indicator arrangement may be located within the helical guide path defined by the helix formation extending externally from the hollow pole in a configuration in which a loop formation, formed at the end of a flexible line for connecting a ball to the pole and engaging the pole, is guided towards a central location of the guide formation, where the stop means defines a formation that can trap a knot formed along the flexible line, or any other formation provided along the flexible line, where the loop formation is formed, to stop rotation of the loop formation about the pole. Each trigger element may be displaceably located on the pole, each trigger element being displaceable about the longitudinal axis of the pole in response to a force applied thereto by the flexible line in response to the stop means trapping a knot formed along the flexible line where the loop formation is formed and whereby the flexible line is engaged with the pole.

Further according to the invention, the trap arrangement of the tether tennis game apparatus may include a second tubular housing which is securely located within the pole and within which the first tubular housing is rotatably located, the stop means of each trigger element being operatively linked with the first tubular housing via an opening defined therefor in the second tubular housing, providing for rotation of the first tubular housing within the second tubular housing in response to displacement of the trigger element when its stop means stops the rotation of the loop formation of a flexible line around the pole, in response providing for release of the indicator element from its spring-loaded trapped position for displacement to its release position. The second tubular housing may define the trap formation on its operative internal side, this formation being releasably engaged by the pin formation projecting from the indicator element for trapping the indicator element, rotational displacement of the first tubular housing providing for release of the pin formation from the trap formation and thereby the displacement of the indicator element from its trapped position to its release position. A suitable spring, or the like, may act on the first tubular housing for urging it into a position in which the pin formation projecting from the indicator element engages the trap formation defined by the second tubular housing, permitting displacement against the bias of the spring for both release of the pin formation and for subsequent engagement by the trap formation of the pin formation when the indicator element is again displaced into its spring-loaded trapped position.

It will be appreciated that the exact configuration of the indicator arrangement of the tether tennis game apparatus of the invention as envisaged is greatly variable while it can still provide for the displacement of an indicator element from a spring-loaded trapped position to a release position, as required in relation to a tether tennis game apparatus for indicating a winner of a game. A winner clearly is indicated by the displacement of the elongate indicator element of the indicator arrangement from its spring-loaded trapped position to its release position and by the rotation of the propeller element rotatably located on the indicator element, which clearly renders the displacement of the indicator element more visible.

The above and further features of the tether tennis game apparatus of the invention are described in more detail hereinafter with reference to an example of an apparatus which is illustrated in the accompanying diagrammatic drawings. In the drawings.

Figure 1:
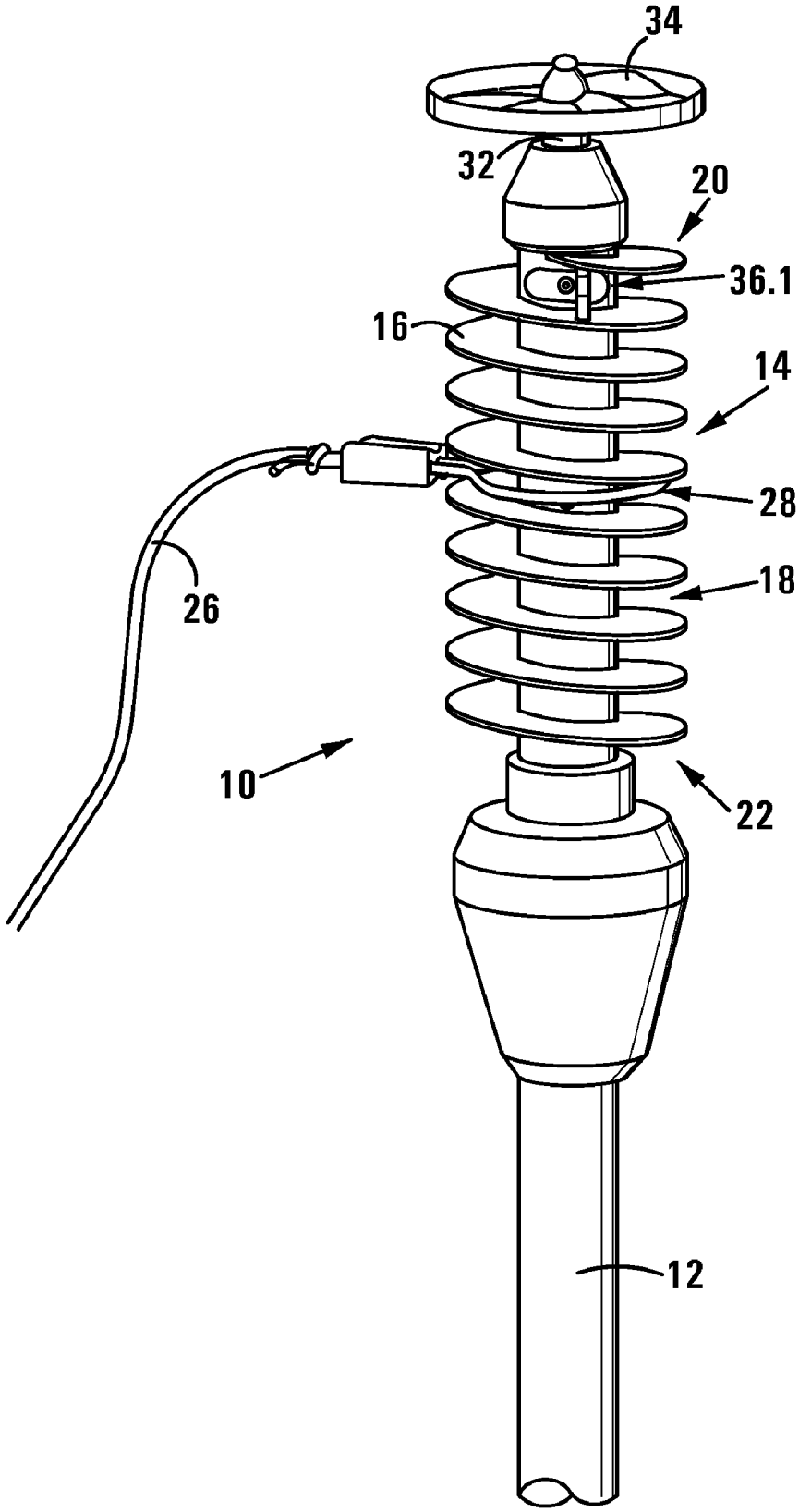
FIGS. 1 to 3 show perspective side views of a tether tennis game apparatus, in accordance with the invention, illustrating the mode of use of the apparatus.
Figure 2:
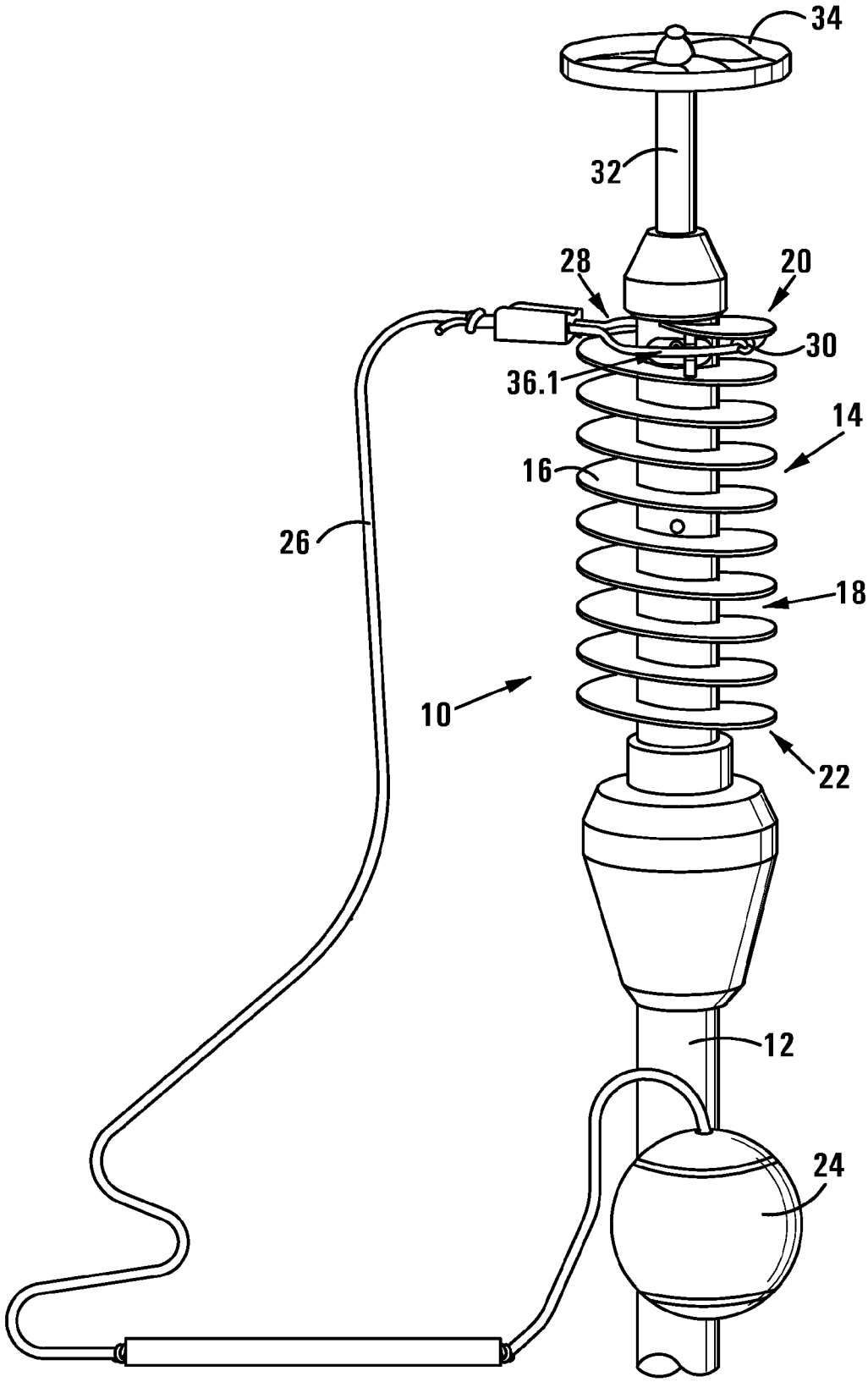
Figure 3:
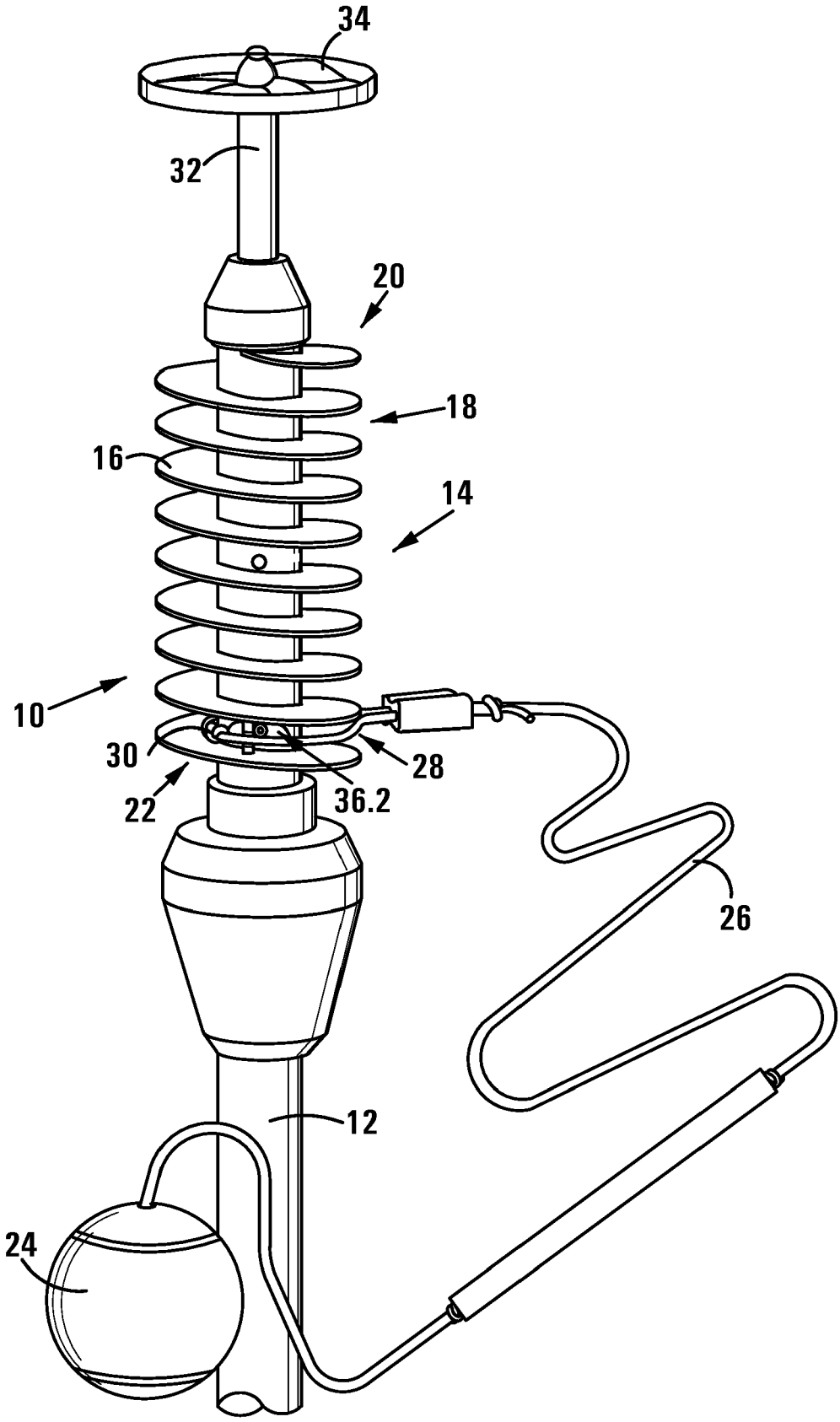

Referring initially to FIGS. 1 to 3 of the drawings, a tether tennis game apparatus, in accordance with the invention, is designated generally by the reference numeral 10. The apparatus 10 includes an elongate pole 12 which can be supported in an upright configuration with respect to the ground, the pole 12 having an operative top segment 14 which has a helix formation 16 extending externally therefrom, the helix formation 16 defining a helical guide path 18 along the segment between an operative top end 20 of the segment and an operative bottom end 22 of the segment.

The apparatus includes also a tennis-type ball 24 that is operatively engaged with the pole 12 in the region of the segment 14 by an elongate flexible line 26. The line 26 has a loop formation 28 formed at the end thereof remote from the ball 24, the loop formation 28 engaging the segment 14 of the pole 12 in the configuration as shown, particularly with the loop formation trapped within the helical path 18 defined by the helix formation 16. The flexible line 26 has a knot 30 formed therein in the location of the loop formation 28, which is provided for the purpose which is described in more detail hereafter.

The apparatus 10 includes also an indicator arrangement which can indicate when a game played by two people is won, the exposed parts of the indicator arrangement shown in FIGS. 1 to 3 including an elongate indicator element in the form of a rod 32, a propeller 34 rotatably located on the exposed free end of the rod 32 and two trigger elements 36.1 and 36.2 located within the helical guide path 18, respectively near the operative top end 20 of the segment 14 and near the operative bottom end 22 of the segment 14.

A game using the apparatus 10 usually is played between two players that each have a racquet whereby the ball 24 can be struck, particularly for displacement in opposite, substantially circular paths around the pole 12. It will be understood in this regard that if the ball 24 is displaced in one direction around the pole more often than the other, typically as a result of a player occasionally missing the ball in his attempts to strike the ball, the loop formation 28 will be displaced axially along the pole within the guide path 18. As such, it is an objective of the game for one player to induce the other player to miss the ball a sufficient number of times in order for the loop formation 28 to reach the other player's end of the segment 14, i.e. for the loop formation 28 to be displaced into the region of the guide path 18 where a trigger element 36.1, 36.2 is located.

As shown in FIG. 1, play is initiated with the loop formation 28 centrally located between the opposite ends of the segment 14. As play continues, the loop formation 28 will be displaced upwardly or downwardly along the helical guide path 18, depending on one player missing the ball in his attempts to strike the ball with his racquet more often than the other player. As shown in FIG. 2 of the drawings, when the loop formation 28 reaches the top end of the guide path 18, the rotation of the loop formation 28 around the pole will be stopped as a result of the knot 30 in the loop formation being trapped by the trigger element 36.1, inducing the elongate rod 32 to be released from a spring-loaded trapped position as shown in FIG. 1, into a release position as shown in FIG. 2. As a result of this release and also as described hereafter, rotation of the propeller 34 will be induced, rendering clearly visible that a player has won a game. The same will occur when the loop formation 28 reaches the operative bottom end of the guide path 18, where the knot 30 in the loop formation will be trapped by the trigger element 36.2, inducing displacement of the rod 32 and propeller 34 into the position as shown in FIG. 3. It will be appreciated in this regard that by pressing the rod 32 back into the segment 14 of the pole 12, it is again displaced into its spring-loaded trapped position as shown in FIG. 1, thus to allow players to commence a new game. The operation of the complete indicator arrangement is explained in more detail hereafter.

Figure 4:
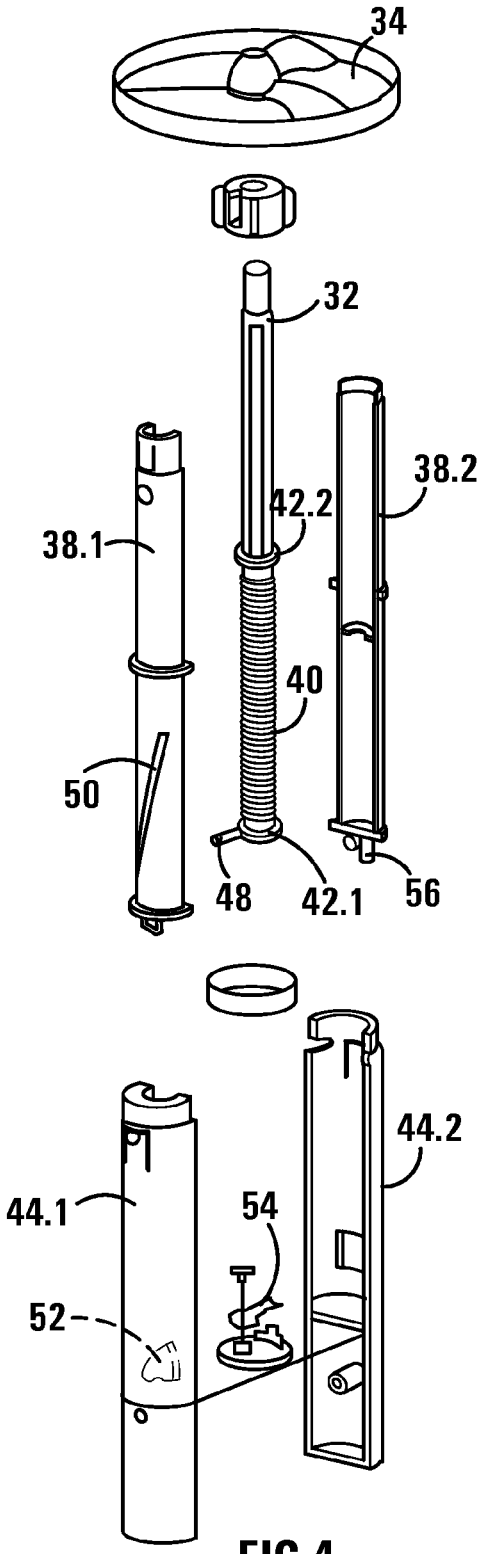
FIG. 4 shows an exploded three-dimensional view of parts forming an indicator arrangement of the apparatus as shown in FIGS. 1 to 3.
Figure 5:
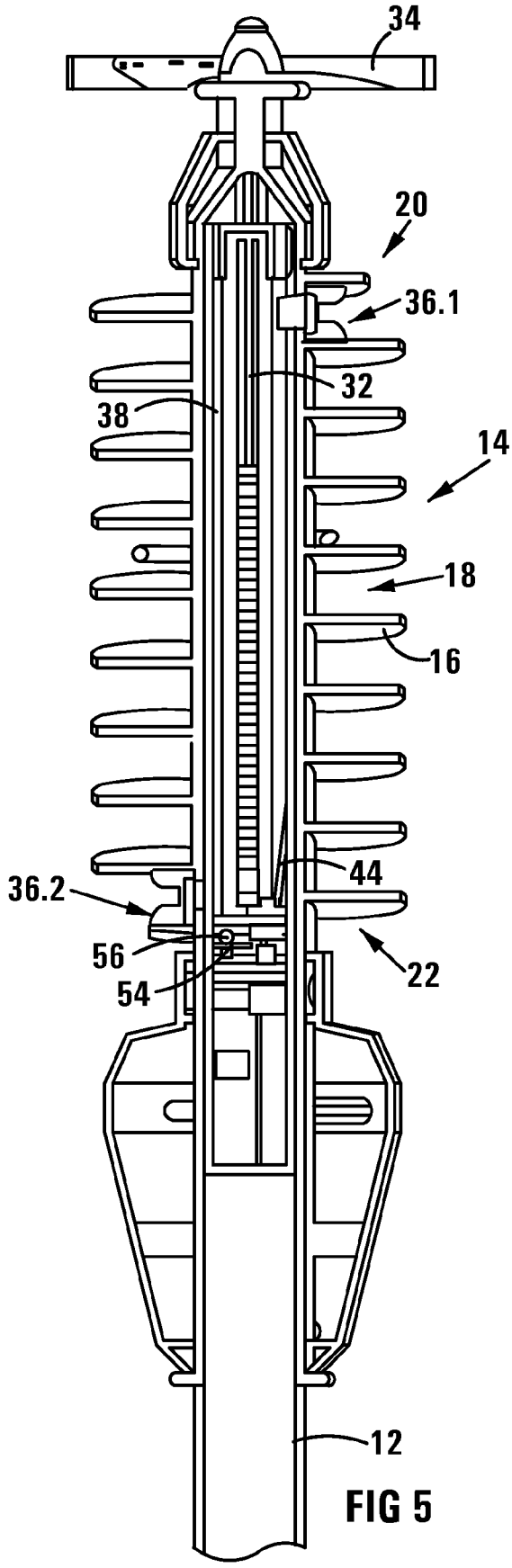
FIG. 5 shows in cross-sectional side view the indicator arrangement of FIG. 4, in its operative configuration as part of the apparatus of FIGS. 1 to 3.
Figure 6:
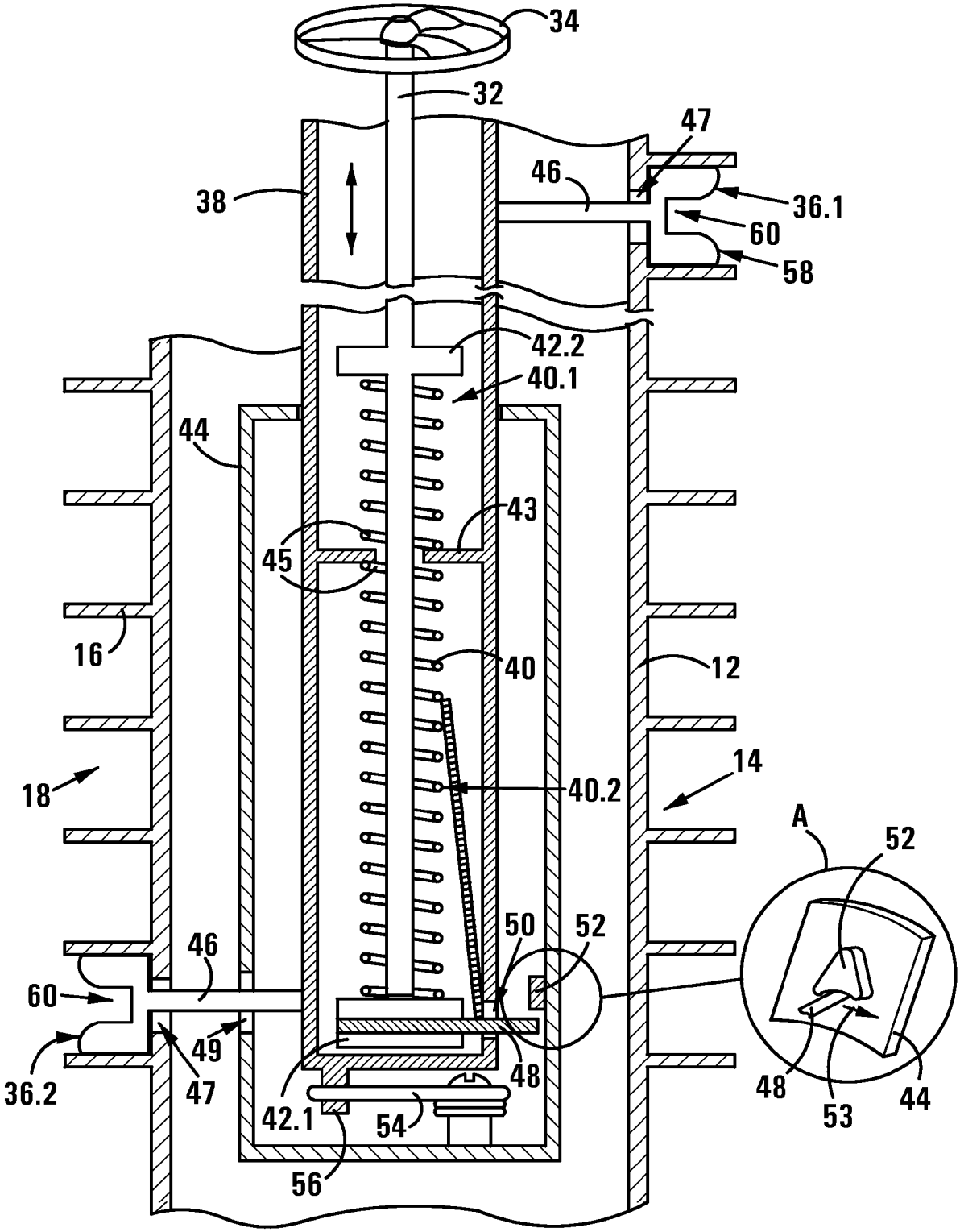
FIG. 6 illustrates schematically and in cross-sectional side view the operation of the indicator arrangement of FIG. 4.

Referring now also to FIGS. 4 to 6 of the drawings, the indicator arrangement of the apparatus 10 is shown in exploded view in FIG. 4 and in its operative assembled form in FIG. 5, while FIG. 6 serves particularly to illustrate the operation thereof. As shown, the rod 32 of the indicator arrangement, which has the propeller 34 rotatably located at the operative top end thereof, is displaceably located within a first tubular housing 38 formed of two housing parts, 38.1 and 38.2 respectively, a coil spring 40 being located on the rod 32 between collar formations 42.1 and 42.2 with which the respective opposite ends of the spring 40 are engaged. As shown clearly in FIG. 6 of the drawings, the housing 38 defines an internal flange formation 43 that defines a central aperture through which the rod 32 is freely displaceable, the flange formation 43 being located between two adjacent coils 45 of the coil spring 40, for effectively dividing the coil spring 40 into an upper coil spring segment 40.1 and a lower coil spring segment 40.2. It must be appreciated in this regard that with the rod 32 displaced into its spring-loaded trapped position as shown in FIG. 6, the segment 40.1 of the coil spring 40 is compressed while the segment 40.2 of the coil spring 40 is tensioned, the rod 32 thus being urged for displacement away from this spring-loaded trapped position into its release position, which is the position of the rod 32 as shown in FIGS. 2 and 3 of the drawings. The mode in which the rod 32 is held in its spring-loaded trapped position is explained hereafter.

The first tubular housing 38 of the indicator arrangement of the apparatus 10 is itself partially located within a second tubular housing 44, this second tubular housing 44 again being formed of two housing parts, 44.1 and 44.2 respectively. In the operative configuration of the second tubular housing 44 it is securely located within the segment 14 of the pole 12, whereas the first tubular housing 38 is rotatably located within the second tubular housing 44. As is illustrated clearly in FIG. 6 of the drawings, the trigger elements 36.1 and 36.2 are directly connected to the first tubular housing 38 by connecting rods 46, the rods 46 extending through slot formations 47 defined therefor within the segment 14 of the pole 12 and, in relation to the trigger element 36.2, a further slot formation 49 defined therefor in the second tubular housing 44.

In order to hold the rod 32 in its spring-loaded trapped position, a pin formation 48 projects substantially radially from the collar formation 42.1, particularly through an elongate slot 50 (see FIG. 4) defined in the first tubular housing 38, the free end of the pin formation 48 being trapped beneath a trap formation 52 that projects from the second tubular housing 44 (see detail A in FIG. 6 of the drawings). In order to release the free end of the pin formation 48 from beneath the trap formation 52, rotation of the first tubular housing 38 is required, which will induce the required relative displacement of the pin formation 48 in, for example, the direction of arrow 53 (see cut-away detail A of FIG. 6), for its release from the trap formation 52. It will be understood in this regard that in response to the pin formation 48 being released from the trap formation 52, the rod 32 will be displaced into its release position and when again pressed down into its spring-loaded trapped position, the pin formation 48 by-passes the trap formation 52 by permitted rotation of the first tubular housing 38, thereby providing for engagement with the trap formation 52. A spring element 54 particularly acts between the second tubular housing 44 and a formation 56 projecting from the first tubular housing 38, for urging the first tubular housing into a position in which the pin formation is trapped, any rotation of the first tubular housing thus being against the biasing force of the spring element 54, as will be clearly apparent from what follows.

Referring particularly also to FIG. 6, each trigger element 36.1, 36.2 that is located within the guide path 18 defined by the helix formation 16 defines a guide formation part 58, that serves to guide the loop formation 28 of the flexible line 26, whereby a ball is engaged with the pole 12, towards a stop formation part 60, the stop formation part 60 being configured to prevent the knot 30 in the loop formation by-passing the stop formation 60, thus to prevent further rotation of the loop formation about the pole 12 (see also FIGS. 1 to 3). As a result of the centrifugal force acting on the ball 24 during its displacement around the pole, the stopped loop formation 28 will act on the trigger element 36.1, 36.2 which has stopped the rotation thereof about the pole, inducing displacement of the trigger element 36.1, 36.2 a small distance about the pole. This displacement is transferred to the first tubular housing 38 by a connecting rod 46 to induce rotation thereof. This is the rotation that results in the pin formation 48 escaping from the trap formation 52, thus providing for the displacement of the rod 32 to its release position, for indicating a winner of a game as explained above.

The displacement of the pin formation 48 for its release from the trap formation 52 particularly results from a relatively snug fit of the pin formation in the slot 50. The force of the spring element 54 acting on the first tubular housing further is such that required displacement of the pin formation 48 with respect to the trap formation 52 is permitted, either in order to provide for the required release of the pin formation from the trap formation, or required re-engagement of the pin formation with the trap formation.

It will further be understood that following the release of the rod 32 for its displacement to its release position, the pin formation 48 will be displaced along the slot 50 which, as is shown clearly in FIG. 4, follows a helical path around the housing 38. This will induce rotation of the rod about its longitudinal axis which, in turn, will induce rotation of the propeller 34 at the free top end of the rod, as it is displaced into its position as shown in FIGS. 2 and 3. The displacement of the rod 32 and rotation of the propeller 34 will be clearly visible, thus clearly identifying the fact that a player has won a game.

It must be understood that the exact construction of the apparatus of the invention and, particularly, of the indicator arrangement, is greatly variable. The configuration and the operation of the trigger elements 36.1, 36.2 particularly is such that, when either element stops the rotation of the loop formation 28 of the flexible line 26 about the pole 12, the operation of the indicator arrangement is initiated. This provides a clear indication to players that a game has been won.

The invention claimed is:

1. A tether tennis game apparatus comprising:

a hollow pole having a helix formation extending externally therefrom along an operative top segment thereof, the helix formation defining a helical guide path along the operative top segment, between an operative top end and an operative bottom end of the operative top segment a flexible line having a first end and a second end, a loop formation formed at the first end of the flexible line and a ball connected to the second end of the flexible line, the loop formation positioned around the hollow pole and displaced upwardly or downwardly along the helical guide path, engaging the flexible line with the hollow pole, an indicator arrangement including an elongate indicator element located for axial displacement within the hollow pole, the elongate indicator element being displaceable from a spring-loaded trapped position in which the elongate indicator element is retracted into the hollow pole, to a release position in which the elongate indicator element has moved operatively upwardly and extending outwardly from the operative top end of the hollow pole;

two trigger elements located within the helical guide path defined by the helix formation of the hollow pole near the respective top and bottom operative ends of the helical guide path, each trigger element defining a guide formation and a stop formation part, the guide formation being configured operatively to guide the loop formation formed at the end of the flexible line to which the ball is connected and engaging the flexible line with the hollow pole, when rotatably displaced around the hollow pole and axially displaced with respect to the hollow pole along the helical guide path, to the stop formation part, which stops the rotation of the loop formation around the hollow pole and which is displaced in response to stopping the rotation of the loop formation around the hollow pole; and a trap arrangement located within the hollow pole and defining a trap formation for releasably trapping the elongate indicator element in the spring-loaded trapped position, the trap formation and the elongate indicator element being displaced with respect to one another, in response to displacement of the stop formation part, for releasing the elongate indicator element for displacement to a release position.

2. A tether tennis game apparatus as claimed in claim 1, in which the elongate indicator element is an elongate rod-like element and in which the indicator arrangement includes a first tubular housing within which the indicator element is displaceably located, the first tubular housing having a spring located therein that acts between the indicator element and the first tubular housing to provide for spring loading of the indicator element when displaced into trapped position and for displacement of the indicator element to the release position upon release by the trap formation of the trap arrangement.

3. A tether tennis game apparatus as claimed in claim 2, in which the elongate indicator element has a pin formation projecting therefrom that extends through a slot defined therefor in the first tubular housing, the slot extending axially along the first tubular housing for serving as a guide path for displacement of the elongate indicator element between the spring-loaded trapped position and the release position.

4. A tether tennis game apparatus as claimed in claim 3, in which the slot defined in the first tubular housing defines a helical path axially along the first tubular housing, the slot, by having the pin formation projecting from the elongate indicator element extending therethrough, inhibiting free rotation of the elongate indicator element at any axial location thereof between the trapped position and the release position while inducing restricted rotation of the elongate indicator element during displacement from the trapped position to the release position.

5. A tether tennis game apparatus as claimed in claim 4, in which the indicator arrangement includes a propeller element rotatably located on a free end of the elongate indicator element that projects from the hollow pole of the apparatus in a configuration in which rotation of the indicator element upon displacement from the trapped position to the release position induces rotation of the propeller element.

6. A tether tennis game apparatus as claimed in claim 1, in which the guide formation of each one of said two trigger elements of the indicator arrangement is located within the helical path defined by the helix formation extending externally from the hollow pole in a configuration in which the loop formation, formed at the end of the flexible line for connecting the ball to the hollow pole and engaging the hollow pole, is guided towards a central location of the guide formation, where the stop formation part defines a formation that can trap a knot formed along the flexible line where the loop formation is formed, to stop rotation of the loop formation about the hollow pole.

7. A tether tennis game apparatus as claimed in claim 6, in which each one of said two trigger elements is displaceably located on the hollow pole, each trigger element being displaceable about the longitudinal axis of the hollow pole in response to a force applied thereto by the flexible line in response to the stop formation part trapping the knot formed along the flexible line where the loop formation is formed and whereby the flexible line is engaged with the hollow pole.

8. A tether tennis game apparatus as claimed in claim 1, in which the trap arrangement includes a second tubular housing which is securely located within the hollow pole and within which the first tubular housing is rotatably located, the stop formation part of each one of said two trigger elements being operatively linked with the first tubular housing via an opening defined therefor in the second tubular housing, providing for rotation of the first tubular housing within the second tubular housing in response to displacement of the one of said two trigger elements when the stop formation part stops the rotation of the loop formation of the flexible line around the hollow pole, in response providing for release of the indicator element from the spring loaded trapped position for displacement to the release position.

9. A tether tennis game apparatus as claimed in claim 8, in which the second tubular housing defines the trap formation on an operative internal side, this formation being releasably engaged by the pin formation projecting from the indicator element for trapping the indicator element, rotational displacement of the first tubular housing providing for release of the pin formation from the trap formation and thereby the displacement of the indicator element from the trapped position to the release position.

10. A tether tennis game apparatus as claimed in claim 9, in which the spring acts on the first tubular housing for urging it into a position in which the pin formation projecting from the elongate indicator element engages the trap formation defined by the second tubular housing, permitting displacement against a bias of the spring for both release of the pin formation and for subsequent engagement by the trap formation of the pin formation when the elongate indicator element is again displaced into the spring-loaded trapped position.

* * * * *